United States Patent [19]

Ikenoue et al.

[11] Patent Number: 4,647,527

[45] Date of Patent: Mar. 3, 1987

[54] SILVER HALIDE COLOR PHOTOGRAPHIC LIGHT-SENSITIVE MATERIALS COMPRISING COMBINATION OF COLOR-FORMING COUPLER AND COLORED COUPLER

[75] Inventors: Shinpei Ikenoue; Akikazu Mikawa; Seiji Ichijima, all of Kanagawa, Japan

[73] Assignee: Fuji Photo Film Co., Ltd., Kanagawa, Japan

[21] Appl. No.: 612,837

[22] Filed: May 22, 1984

[30] Foreign Application Priority Data

May 23, 1983 [JP] Japan ..... 58-90411

[51] Int. Cl.[4] ..... G03C 1/08; G03C 1/46; G03C 7/26; G03C 7/32

[52] U.S. Cl. ..... 430/505; 430/359; 430/365; 430/503; 430/504; 430/506; 430/549

[58] Field of Search ..... 430/503, 504, 505, 506, 430/549, 365, 359

[56] References Cited

U.S. PATENT DOCUMENTS

| | | | |
|---|---|---|---|
| 3,808,945 | 5/1974 | Matsuo et al. | 430/549 |
| 3,990,899 | 11/1976 | Shiba et al. | 430/505 X |
| 3,996,055 | 12/1976 | Minagawa et al. | 430/359 X |
| 4,004,929 | 1/1977 | Orvis | 430/359 X |
| 4,221,860 | 9/1980 | Hirose et al. | 430/549 X |
| 4,294,900 | 10/1981 | Aono | 430/359 X |
| 4,458,012 | 7/1984 | Ito et al. | 430/553 X |

*Primary Examiner*—John E. Kittle

*Assistant Examiner*—Mukund J. Shah

*Attorney, Agent, or Firm*—Sughrue, Mion, Zinn, Macpeak and Seas

[57] ABSTRACT

A silver halide color photographic light-sensitive material is described, which is of ultra-high-sensitivity and is characterized by having the following light-sensitive layer unit (I), (II) or (III):

Unit (I): a light-sensitive layer unit comprising: (a) a blue- and green-sensitive layer containing (a-1) a yellow image-forming coupler, (a-2) a magenta image-forming coupler, and (a-3) a cyan colored coupler; and (b) a green- and red-sensitive layer containing (b-1) a cyan image-forming coupler, (b-2) a magenta image-forming coupler, and (b-3) a yellow colored coupler.

Unit (II): a light-sensitive layer unit comprising: (a) a blue- and red-sensitive layer containing (a-1) a yellow image-forming coupler, (a-2) a cyan image-forming coupler, and (a-3) a magenta colored coupler; and (b) a green- and red-sensitive layer containing (b-1) a magenta image-forming coupler, (b-2) a cyan image-forming coupler, and (b-3) a yellow colored coupler.

Unit (III): a light-sensitive layer unit comprising: (a) a blue- and green-sensitive layer containing (a-1) a magenta image-formula coupler, (a-2) a yellow image-forming coupler, and (a-3) a cyan colored coupler; and (b) a blue- and red-sensitive layer containing (b-1) a cyan image-forming coupler, (b-2) a yellow image-forming coupler, and (b-3) a magenta colored coupler.

6 Claims, No Drawings

SILVER HALIDE COLOR PHOTOGRAPHIC LIGHT-SENSITIVE MATERIALS COMPRISING COMBINATION OF COLOR-FORMING COUPLER AND COLORED COUPLER

FIELD OF THE INVENTION

The present invention relates to color photography and more particularly to ultra-high sensitivity silver halide color photographic light-sensitive materials.

BACKGROUND OF THE INVENTION

Ultra-high sensitivity silver halide color photographic light-sensitive materials have been strongly desired in recent years, which can be used in a room of insufficient illumination without any electric flash (strobe) or with a strobe of low light quantity, i.e., in a condition as natural as possible, or which can be used in a camera with a telephoto lens under conditions of high shutter speed and high aperture value to take, for example, sport pictures.

It is well known in the art that the sensitivity of silver halide light-sensitive materials can be increased by increasing the size of silver halide grains. However, as described in Farrell et al., *J. Phot. Sci.*, 17 (1969), page 116 and ibid., 9 (1961), page 73, if the size of silver halide grains is increased beyond a certain limit, the efficiency of increasing sensitivity will drop. This is accompanied by undesirable problems, such as a serious reduction in sensitivity/grain size ratio, undesirably high production costs due to the significant amount of silver coated, and deterioration in processing properties, such as a reduction in fixability.

Another means to increase sensitivity is disclosed in, for example, U.S. Pat. Nos. 3,663,228, 3,849,138, 4,184,876 and 4,186,016. In accordance with this method, high-sensitivity blue-sensitive, green-sensitive and red-sensitive layers are placed more away from a support than low-sensitivity green-sensitive and red-sensitive layers and, if necessary, a low-sensitivity blue-sensitive layer. It has been found, however, that even if this method is employed, since the red-sensitive layer is positioned below blue-sensitive and green-sensitive layers, the loss of absorption of light, delay of development, and so forth occur, it impossible to realize ultra-high sensitivity.

It is also known that sensitivity can be increased by shortening the coupling speed of couplers. It has been found, however, that even if such high-coupling speed couplers are used in emulsions formulated to contain silver halide grains of large size for the purpose of increasing sensitivity, the sensitivity can be increased only insufficently, and a deterioration of graininess is undesirably involved.

Another method of increasing sensitivity is disclosed in U.S. Pat. No. 3,497,350, in which at the furthest position from a support is placed a light-sensitive emulsion layer which contains a black image-forming coupler or a combination of yellow image-forming coupler, magenta image-forming coupler and cyan image-forming coupler, and which is sensitized to red light and to green light. However, this method has been found also undesirable, since deterioration in color is involved.

Thus, it has been strongly desired to develop a satisfactory means to achieve high sensitization.

SUMMARY OF THE INVENTION

The present inventors have been repeated various investigations in order to developing a novel means to achieve high sensitization, and achieved the present invention.

An object of the invention is to provide ultra-high sensitivity silver halide color photographic light-sensitive materials.

Another object of the invention is to provide ultra-high sensitivity silver halide color photographic light-sensitive materials which are of good graininess.

Still another object of the invention is to provide ultra-high sensitivity silver halide color photographic light-sensitive materials which are good in color reproductivity.

It has been found that the objects are attained by providing light-sensitive layer unit (I), (II) or (III) as described hereinafter.

The present invention relates to a silver halide color photographic light-sensitive material comprising a support and having the following light-sensitive layer unit (I), (II) or (III):

Unit (I)

a light-sensitive layer unit comprising:

(a) a silver halide light-sensitive layer which contains a color-forming combination of (a-1) a yellow image-forming coupler, (a-2) a magenta image-forming coupler, and (a-3) a cyan colored coupler, and which is blue-sensitive and green-sensitive; and (b) a silver halide light-sensitive layer which contains a color-forming combination of (b-1) a cyan image-forming coupler, (b-2) a magenta image-forming coupler, and (b-3) a yellow colored coupler, and which is green-sensitive and red-sensitive.

Unit (II)

a light-sensitive layer unit comprising:

(a) a silver halide light-sensitive layer which contains a color-forming combination of (a-1) a yellow image-forming coupler, (a-2) a cyan image-forming coupler, and (a-3) a magenta colored coupler, and which is blue-sensitive and red-sensitive; and (b) a silver halide light-sensitive layer which contains a color-forming combination of (b-1) a magenta image-forming coupler, (b-2) a cyan image-forming coupler, and (b-3) a yellow colored coupler, and which is green-sensitive and red-sensitive.

Unit (III)

a light-sensitive layer unit comprising:

(a) a silver halide light-sensitive layer which contains a color-forming combination of (a-1) a magenta image-forming coupler, (a-2) a yellow image-forming coupler, and (a-3) a cyan colored coupler, and which is blue-sensitive and green-sensitive; and (b) a silver halide light-sensitive layer which contains a color-forming combination of (b-1) a cyan image-forming coupler, (b-2) a yellow image-forming coupler, and (b-3) a magenta colored coupler, and which is blue-sensitive and red-sensitive.

DETAILED DESCRIPTION OF THE INVENTION

The term "colored coupler" is used herein to indicate compounds releasing a dye or its precursor (a group capable of being converted into the dye at the time of development) on reacting with oxidized developing agents.

The term "green light" as used herein means light having a wavelength region falling mainly within the range of from 500 to 600 nm, and the term "red light" means light having a wavelength region falling mainly within the range of from 600 to 700 nm. Thus, in spectral sensitization to green light, the longer wavelength end and shorter wavelength end of the spectral sensitivity may be above 600 nm and below 500 nm, respectively. Also, in spectral sensitization to red light, the longer wavelength end and shorter wavelength end of the spectral sensitivity may be above 700 nm and below 600 nm, respectively.

The colored couplers as used herein may be of the type that form color upon oxidative coupling with aromatic primary amine developers (e.g., phenylenediamine derivatives and aminophenol derivatives) at the time of color development, or of the type that does not substantially form color upon such oxidative coupling. When colored couplers of the former type are used, they act as not only colored coupler but also color image-forming couplers; i.e., both the function of a color image-forming coupler and the function of a colored coupler can be attained by using the single compound. For example, when (a-3) the cyan colored coupler of Unit (I) is a cyan colored magenta image-forming coupler, the amount of the magenta image-forming coupler used can be reduced, or the magenta image-forming coupler can be eliminated.

The feature of the present invention resides in that two silver halide emulsion layers showing different light-sensitivities are used to form therein three color (preferably the subtractive three primary colors) images necessary for color reproduction. That is, when a light-sensitive material having the combination of the present invention is irradiated with blue light, green light and red light, a yellow dye, a magenta dye and a cyan dye are formed corresponding to the blue light, green light and red light, but one of the yellow, magenta and cyan dyes can be formed in an amount relatively greater than those of the other two dyes and the influences exerted by the other dyes are reduced by adjusting a mask in printing on a positive material. In this way, the three primary colors of blue, green and red can be appropriately reproduced.

In accordance with the present invention, color reproduction can be attained using two silver halide light-sensitive emulsion layers showing different light-sensitivities although at least three silver halide light-sensitive emulsion layers of different light-sensitivities have been needed in conventional color photographic light-sensitive materials. This enables increasing the sensitivity of the light-sensitive unit of the present invention.

The present invention is advantageously used in high sensitivity color photographic light-sensitive materials. More preferably, it is applied to negative-working color photographic light-sensitive materials to be used in cameras.

In the conventional three layer system, it is generally preferred that a red-sensitive layer be first provided on a support, then a green-sensitive layer on the red-sensitive layer, and finally a blue-sensitive layer on the green-sensitive layer; i.e., the blue-sensitive layer is the uppermost layer. In the light-sensitive material of the present invention, it is preferred for the light-sensitive layer (a) to be spaced apart from the support by the light-sensitive layer (b).

The light-sensitive layer unit of (I), (II) or (III) is insufficient in color reproductivity since the three colors are produced by two light-sensitive layers. For this reason, preferably, the light-sensitive layer unit of the present invention is provided in the high-sensitivity color emulsion layer areas. More specifically, the light-sensitive layer unit is adapted to produce a color density of preferably from 0.05 to 0.4, and more preferably from 0.1 to 0.3, the remaining color density being produced by a light-sensitive layer unit comprising a blue-sensitive layer, a green-sensitive layer and a red-sensitive layer as disclosed in, for example, U.S. Pat. Nos. 3,663,228, 4,173,479, 4,184,876, 4,186,011, 4,267,264, 4,186,016, 3,849,138, 3,843,369, and British Patent No. 1,560,965, which is provided between the light-sensitive layer unit and the support. Theoretically it is preferred to adjust the ratio of the color density of (a-1) to the color density of (a-2) to the mask density of (a-3) in the light-sensitive layer to about 2:1:1. This preferred density ratio, however, varies with the type of measuring filter, the absorption peak value of a color image, the spectral sensitivity, and so forth. Thus the preferred density ratio is quite difficult to define.

In a preferred embodiment of the present invention, an inter layer is sandwiched between the light-sensitive layers (a) and (b). To this inter layer, if necessary, color-mixing preventing agents such as phenol derivatives, hydroquinone derivatives, and gallic acid derivatives may be added. Furthermore, it may be dyed yellow with colloidal silver, yellow dyes, and so forth. In the light-sensitive layer unit (I) or (II), it is preferred for the inter layer to be dyed yellow in a density of from 0.05 to 0.3, preferably from 0.1 to 0.2. Dyeing is achieved by using non-diffusible dyes, or by mordanting with cationic polymers. For example, polymers as described in British Patent 685,475, U.S. Pat. Nos. 2,675,316, 2,839,401, 2,882,156, 3,048,487, 3,184,309, 3,445,231, West German Patent Application (OLS) No. 1,914,362, Japanese Patent Application (OPI) Nos. 47624/75 and 71332/75 (the term "OPI" as used herein means a "published unexamined Japanese patent application") can be used.

In the present invention, compounds capable of forming color upon oxidative coupling with aromatic primary amine developers (e.g., phenylenediamine derivatives and aminophenol derivatives) during the process of color development can be used as color image-forming couplers. For example, as magenta image-forming couplers, a 5-pyrazolone coupler, a pyrazolobenzimidazole coupler, a cyanoacetylcumarone coupler, a open-chain acylacetonitrile coupler, a pyrazolotriazole coupler, etc., can be used; as yellow image-forming couplers, an acylacetamide coupler (e.g., benzoylacetoanilides and pivaloylacetoanilides), etc. can be used; aand as cyan image-forming couplers, a naphthol coupler, a phenol coupler, etc., can be used. These couplers are preferably non-diffusible couplers having a hydrophobic group called a ballast group in the molecule thereof. They may be four-equivalent or two-equivalent relative to silver ion. Furthermore, they may be colored couplers having the effect of color correction, or couplers releasing a development inhibitor with development (i.e., so-called DIR couplers). As well as DIR couplers, colorless DIR coupling compounds producing a colorless coupling reaction product and releasing a development inhibitor may be incorporated.

Typical examples of magenta image-forming couplers are described, for example, in U.S. Pat. Nos. 2,600,788, 2,983,608, 3,062,653, 3,127,269, 3,311,476, 3,419,391, 3,519,429, 3,558,319, 3,582,322, 3,615,506, 3,834,908, 3,891,445, West German Pat. No. 1,810,464, West German Patent Application (OLS) Nos. 2,408,665, 2,417,945, 2,418,959, 2,424,467, Japanese Patent Publication No. 6031/65, Japanese Patent Application (OPI) Nos. 20826/76, 58922/77, 129538/74, 74027/74, 159336/75, 42121/77, 74028/74, 60233/75, 26541/76 and 55122/78.

Typical examples of yellow image-forming couplers are described, for example, in U.S. Pat. Nos. 2,875,057, 3,265,506, 3,408,194, 3,551,155, 3,582,322, 3,725,072, 3,891,445, West German Pat. No. 1,547,868, West German Patent Application (OLS) Nos. 2,219,917, 2,261,361, 2,414,006, British Pat. No. 1,425,020, Japanese Patent Publication No. 10783/76, Japanese Patent Application (OPI) Nos. 26133/72, 73147/73, 102636/76, 6341/75, 123342/75, 130442/75, 21827/76, 87650/75, 82424/77 and 115219/77.

Typical examples of cyan image-forming couplers are described, for example, in U.S. Pat. Nos. 2,367,531, 2,369,929, 2,423,730, 2,434,272, 2,474,293, 2,521,908, 2,772,162, 2,895,826, 3,034,892, 3,311,476, 3,446,622, 3,458,315, 3,476,563, 3,583,971, 3,591,383, 3,758,308, 3,767,411, 3,880,661, 3,996,253, 4,004,929, West German Patent Application (OLS) Nos. 2,414,830, 2,454,329, Japanese Patent Application (OPI) Nos. 59838/73, 26034/76, 5055/73, 146828/76, 69624/77, 90932/77 and 65134/81.

Examples of colored couplers used in the blue and green-sensitive layer, blue and red-sensitive layer or red and green-sensitive layer of the present invention are represented by formulae (I) and (II):

Formula (I)

A-L-Dye

Formula (II)

A-N=N-B

In formulae (I) and (II):

A is a residue resulting from removal of one hydrogen atom existing at the coupling active site of the coupler;

L is a group which is connected to the active site of the coupler, has Dye as a substituent, and is capable of being released after the coupler couples with an oxidized developing agent;

Dye is a dye or a group which is capable of being converted into a dye by development; and B is an aliphatic group, an aromatic group, or a heterocyclic group.

Examples of the coupler residue represented by the symbol A in Formulae (I) and (II), are as follows:

yellow image-forming coupler residues such as coupler residues of the pivaloylacetoanilide, benzoylacetoanilide, malondiester, malondiamide, dibenzoylmethane, benzothiazolylacetamide, malonestermonoamide, benzothiazolylacetate, benzoxazolylacetamide, benzoxazolylacetate, malondiester, benzimidazolylacetamide or benzimidazolylacetate type, and coupler residues as described in U.S. Pat. Nos. 3,770,446, 3,841,880, 4,046,574, British Pat. No. 1,459,171, West German Patent (OLS) No. 2,503,099, Japanese Patent Application (OPI) No. 139738/75, and *Research Disclosure,* No. 15737;

magenta image-forming coupler residues such as coupler residues of the 5-oxo-2-pyrazoline, pyrazolobenzimidazole, pyrazolotriazole, cyanoacetophenone, or indazolone type; and cyan image-forming coupler residues such as coupler residues of the phenol or naphthol type.

Couplers not substantially forming a dye after releasing a release group on coupling with an oxidized developing agent can be used in the present invention with the same effects. Coupler residues of this type are described in U.S. Pat. Nos. 3,632,345, 3,958,993, 3,961,959, 4,052,213 and 4,088,491.

As the release group represented by the symbol L in formula (I), the following examples can be given; i.e., an acyloxy group (e.g., U.S. Pat. No. 3,447,928 and Japanese Patent Application (OPI) No. 39126/78), an aryloxy group (e.g., U.S. Pat. No. 3,408,194), a benzotriazolyl group (e.g., U.S. Pat. Nos. 3,617,291 and 3,933,500), an imido group (e.g., U.S. Pat. Nos. 3,973,968, 4,022,620 and 4,057,432), an acylamino group (e.g., U.S. Pat. No. 4,008,086), an imidazolyl group (e.g., U.S. Pat. No. 4,046,575 and British Patent No. 1,516,547), an arylthio group (e.g., British Patent No. 1,494,777), a pyrazolyl group (e.g., British Patent No. 1,516,547 and U.S. Pat. No. 4,301,235), a triazolyl group (e.g., U.S. Pat. No. 4,076,533), an alkoxyl group (e.g., U.S. Pat. Nos. 4,052,212 and 4,134,766), and an alkylthio group (e.g., U.S. Pat. No. 4,264,723).

The dye represented by the symbol Dye in formula (I) includes an azomethine dye, a diazo dye, a quinonemonoimine dye, an indophenol dye, an indoaniline dye, and a chelate dye. These compounds are all known.

In formula (II), the symbol B represents an aliphatic group, an aromatic group, or a heterocyclic group. In the case of the aliphatic group, it is a substituted or unsubstituted, chain or cyclic, saturated or unsaturated alkyl group having 1 to 32 carbon atoms and preferably 1 to 22 carbon atoms. In the case of the aromatic group, it is preferably a substituted or unsubstituted phenyl or naphthyl group. In the case of the heterocyclic ring, it is preferably a 5- to 7-membered ring and may be substituted or unsubstituted. The hetero atom is chosen from, for example, a nitrogen atom, an oxygen atom, and a sulfur atom.

Representative examples of the colored couplers are shown below.

Coupler
(1)
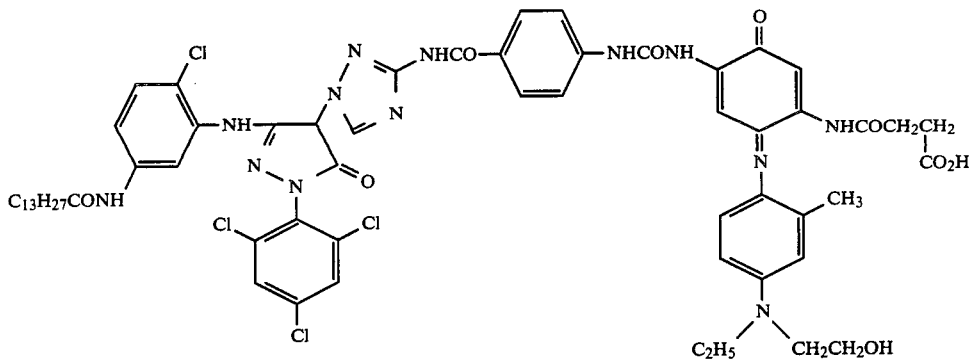
(2)
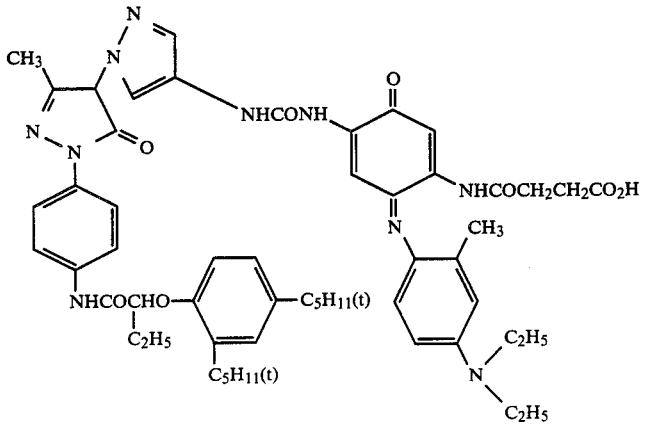
(3)
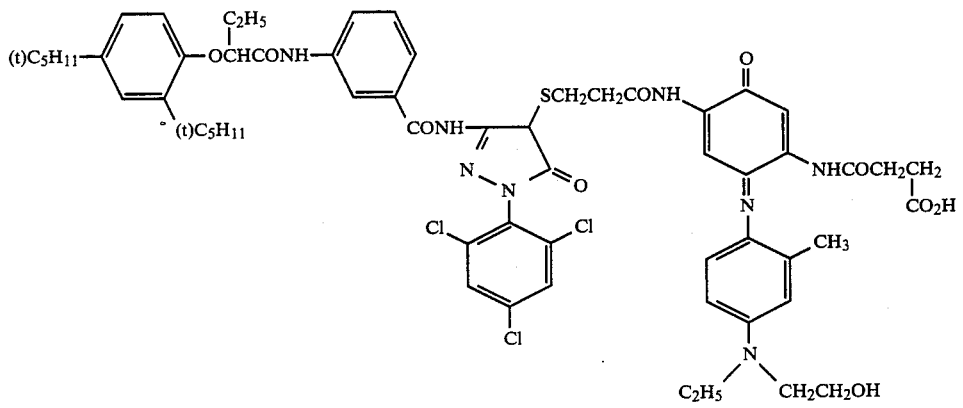
(4)
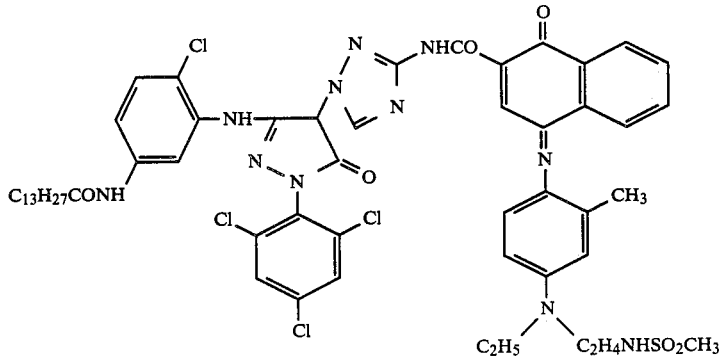

-continued
Coupler
(5)
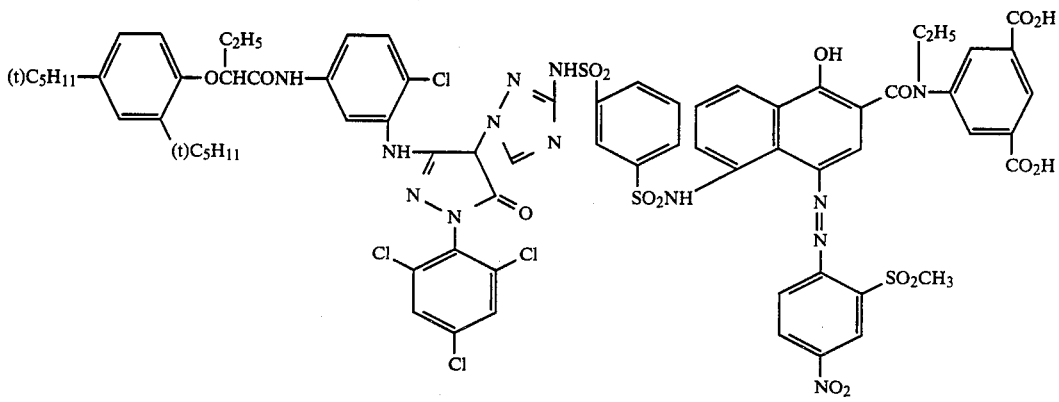
(6)
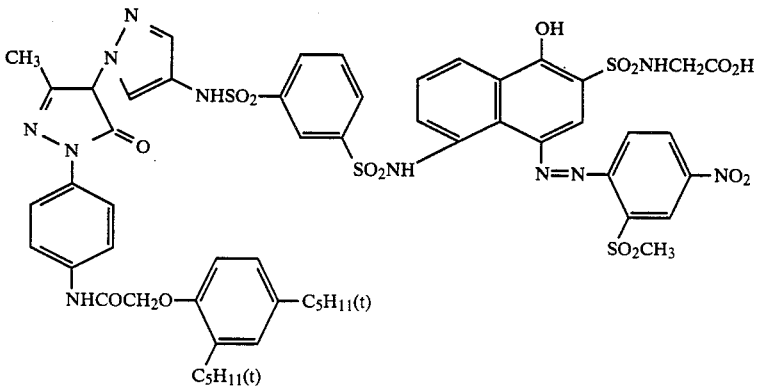
(7)
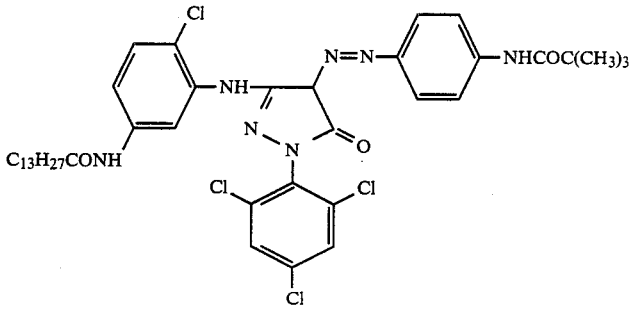
(8)
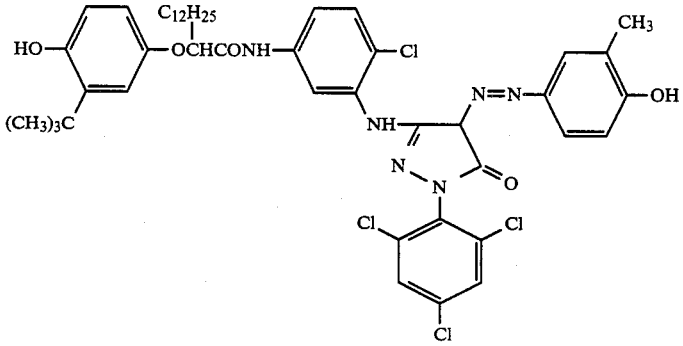

-continued
Coupler
(9)
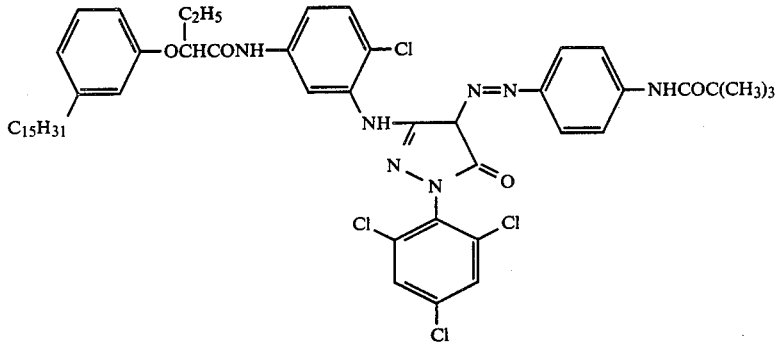
(10)
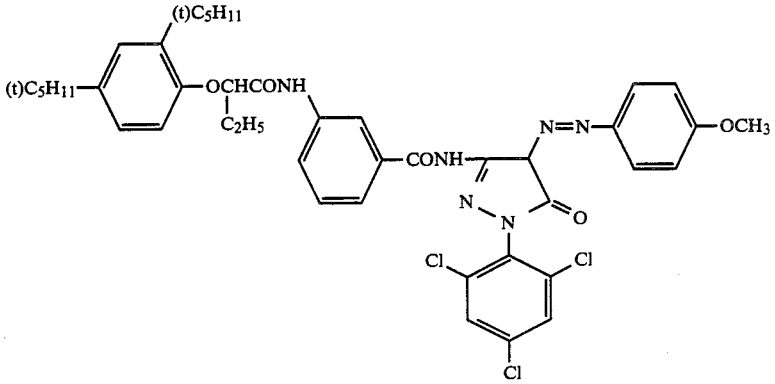
(11)
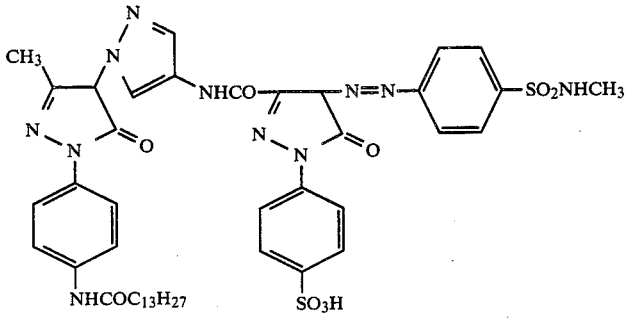
(12)
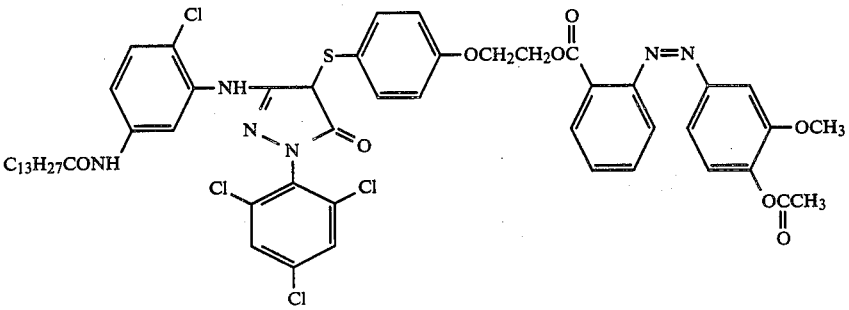

-continued
Coupler
(13)
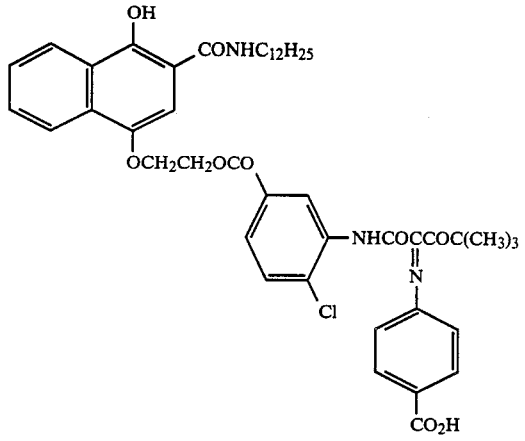
(14)
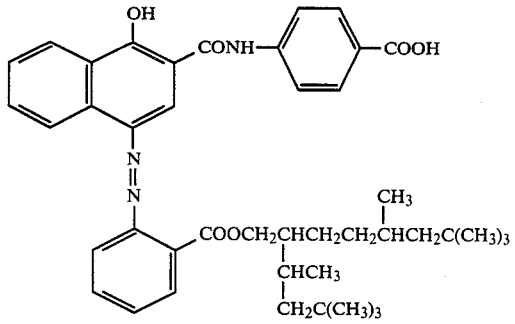
(15)
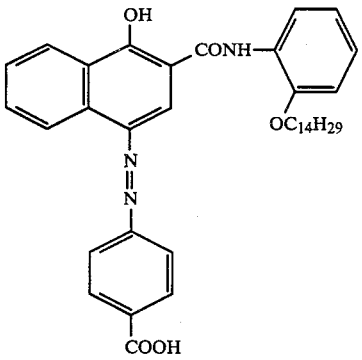
(16)
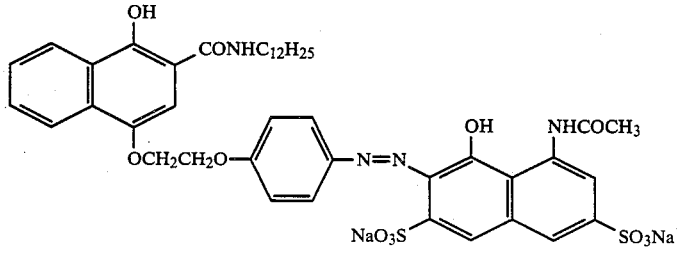

-continued
Coupler
(17)
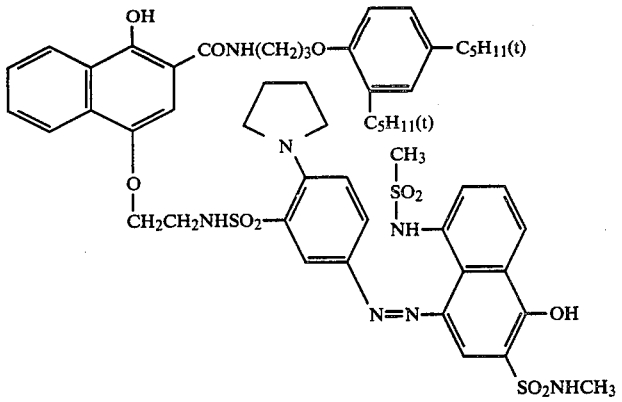
(18)
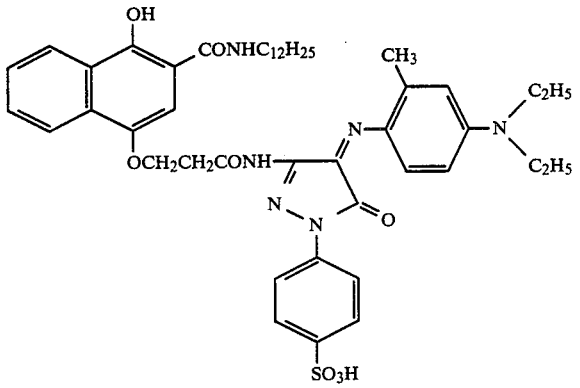
(19)
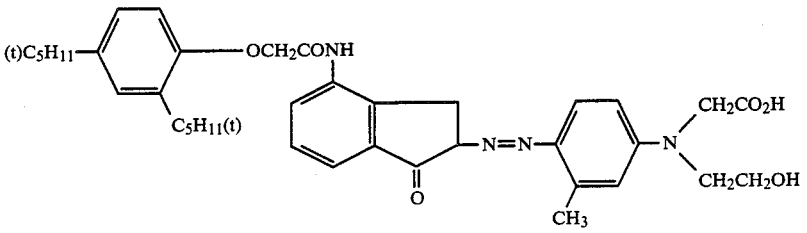
(20)
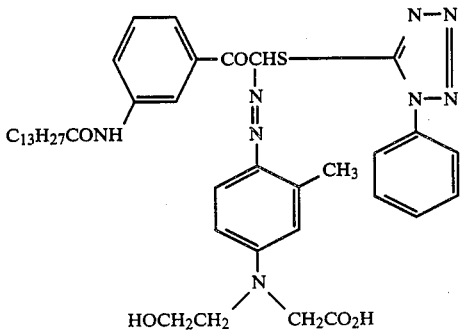

-continued
Coupler
(21)
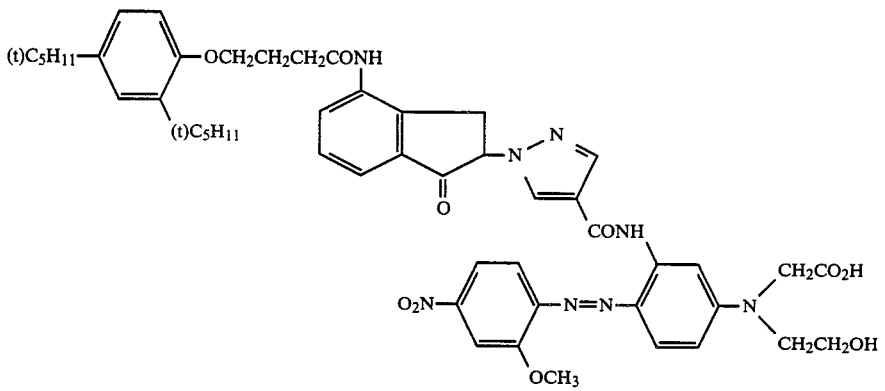
(22)
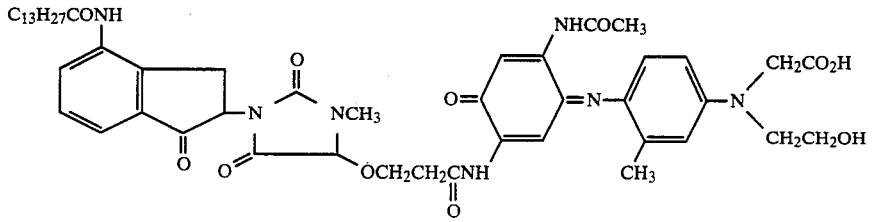
(23)
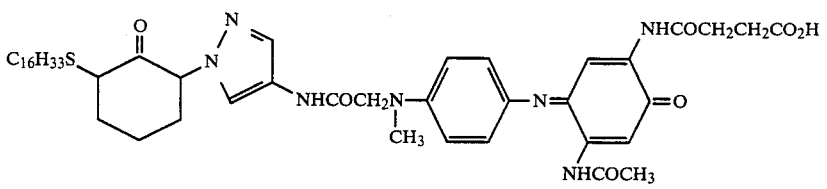
(24)
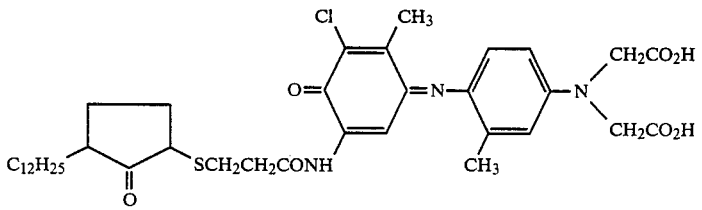
(25)
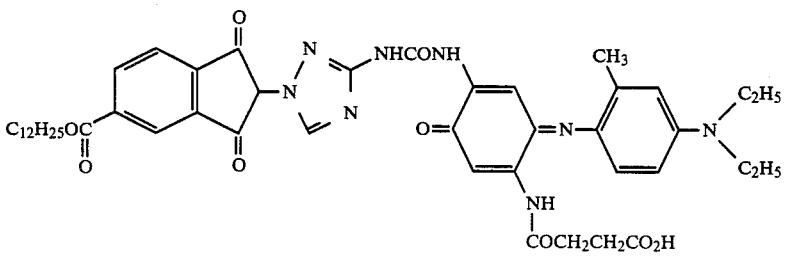

-continued
Coupler
(26)
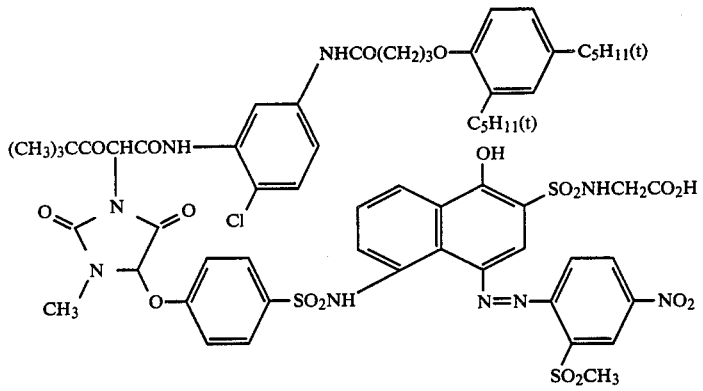
(27)
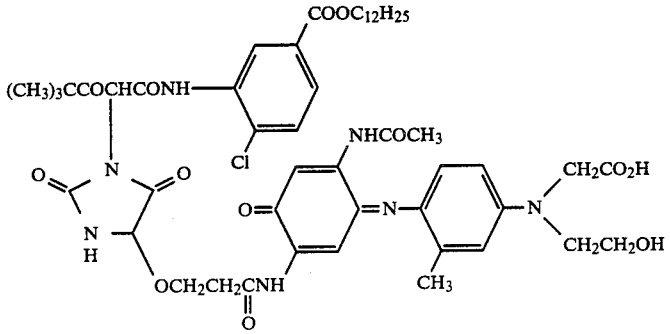
(28)
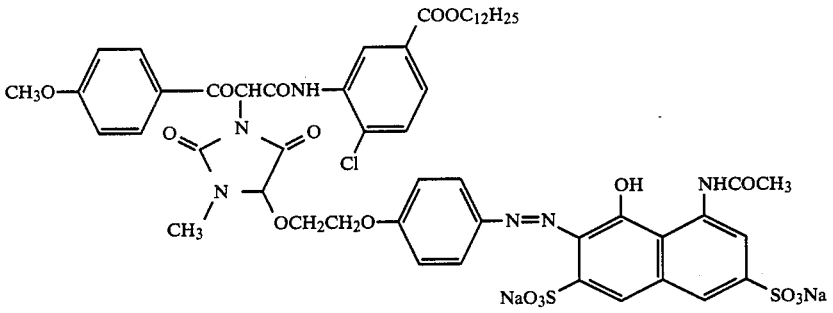
(29)
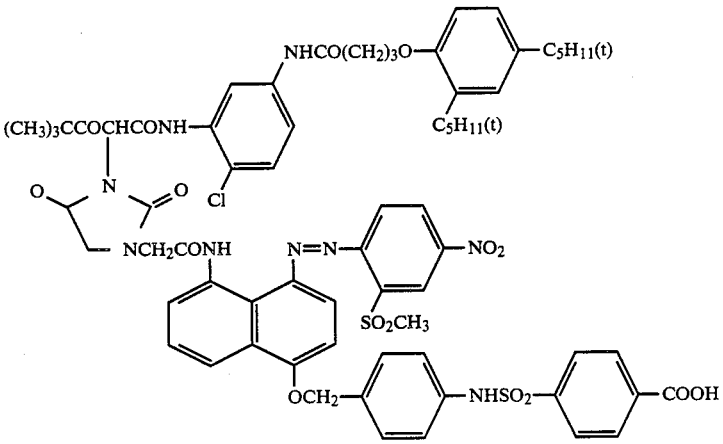

-continued
Coupler
(30)
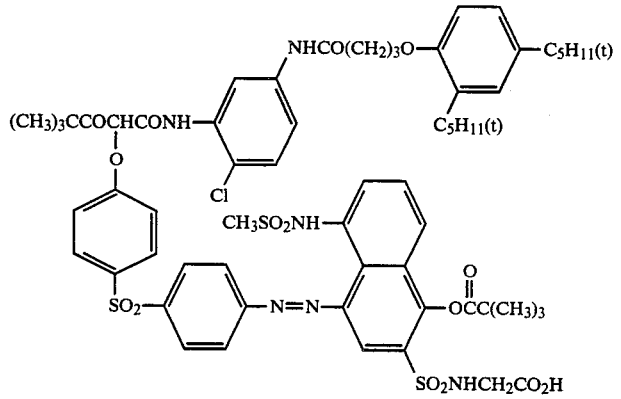
(31)
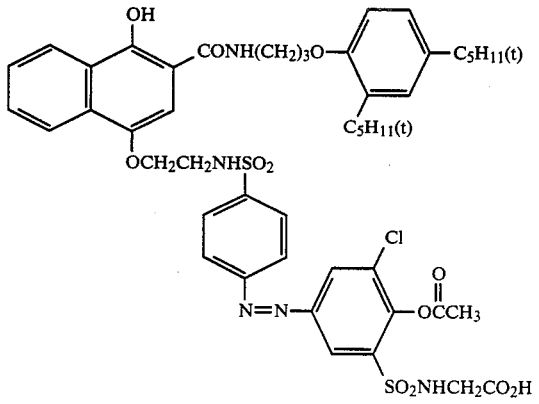
(32)
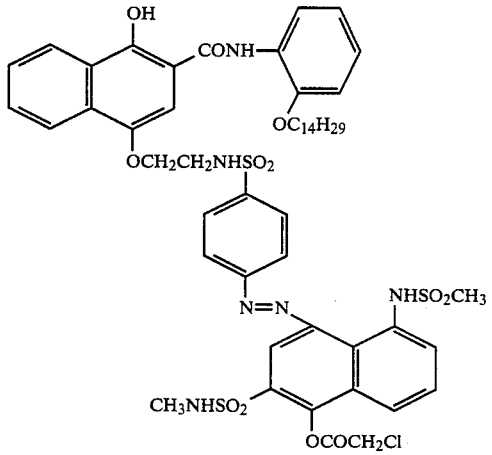
(33)
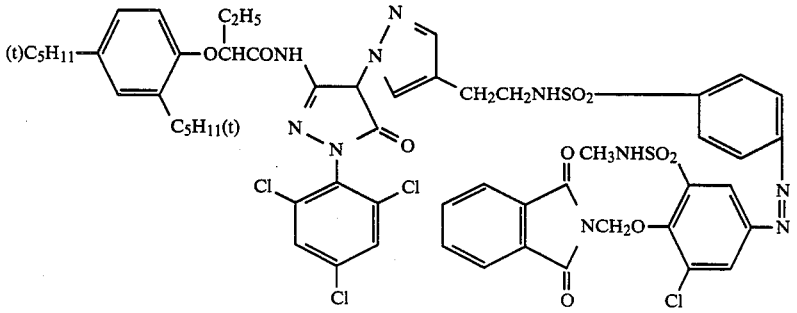

-continued

| Coupler | |
|---|---|
| (34) | 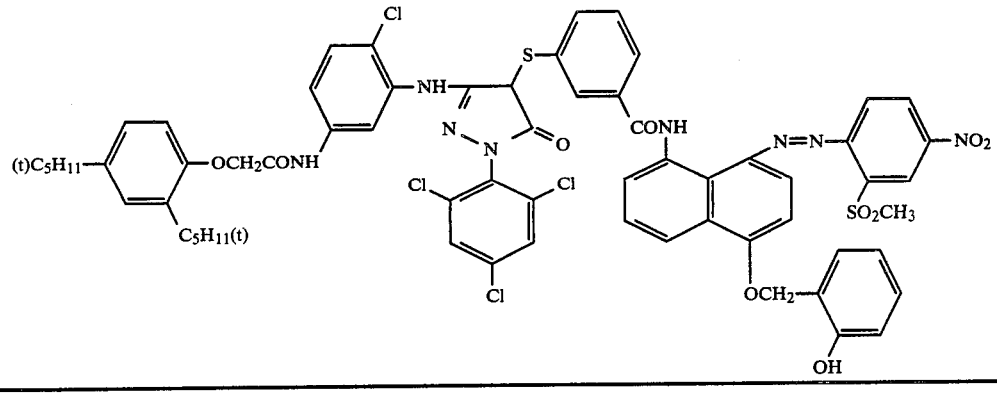 |

In addition, diffusible dye-releasing dyes as described in Japanese Patent Publication No. 19782/79, which produce a diffusible dye and at the same time, a substantially colorless compound, can be used as colored couplers in the present invention.

To the light-sensitive layer unit of the present invention, DIR couplers may also be added.

As these DIR couplers, for example, compounds as described in U.S. Pat. Nos. 3,227,554, 3,617,291, 3,632,345, 3,701,783, 3,790,384, West German Patent Application (OLS) Nos. 2,414,006, 2,454,301, 2,454,329, British Patent 953,454, Japanese Patent Application (OPI) Nos. 69625/77, 122335/74, and Japanese Patent Publication No. 16141/76 can be used.

In addition to DIR couplers, the light-sensitive material of the present invention may contain other compounds releasing a development inhibitor with the progress of development. For example, compounds as described in U.S. Pat. Nos. 3,297,445, 3,379,529, West German Patent Application (OLS) No. 2,417,914, Japanese Patent Application (OPI) Nos. 15271/77 and 9116/78 can be used.

Light-sensitive photographic emulsions as used herein may be subjected to spectral sensitization using, for example, methine dyes.

Useful sensitizing dyes are described, for example, in German Patent No. 929,080, U.S. Pat. Nos. 2,493,748, 2,503,776, 2,519,001, 2,912,329, 3,656,959, 3,672,897, 4,025,349, British Patent 1,242,588, and Japanese Patent Publication No. 14030/69.

These sensitizing dyes may be used in the usual manner. They may be used in combination with each other, and such combinations of sensitizing dyes are often employed for the purpose of supersensitization. Typical examples of such combinations are described in U.S. Pat. Nos. 2,688,545, 2,977,229, 3,397,060, 3,522,052, 3,527,641, 3,617,293, 3,628,964, 3,666,480, 3,672,898, 3,679,428, 3,814,609, 4,026,707, British Patent 1,344,281, Japanese Patent Publication Nos. 4936/68, 12375/78, Japanese Patent Application (OPI) Nos. 110618/77 and 109925/77.

Photographic emulsions as used herein can be prepared by procedures as described in P. Grafkides, *Chimie et Physique Photographique,* published by Paul Montel Co., (1967), G. F. Duffin, *Photographic Emulsion Chemistry,* published by The Focal Press Co., (1966), and V. L. Zelikman et al., *Making and Coating Photographic Emulsion,* published by The Focal Press Co., (1964). That is, any of the acid process, the neutral process, the ammonia process, and so forth can be used. Soluble silver salts and soluble halogen salts can be reacted in any suitable manner such as the single jet process, the double jet process, and a combination thereof.

The so-called reverse mixing method in which silver halide grains are formed in the presence of excess silver ions can be employed. In addition, as an embodiment of the double jet method, the so-called controlled double jet method in which the pAg in a liquid phase where silver halide is formed is maintained at a constant level can be used. This method permits the production of a silver halide emulsion in which the crystal form is regular and the grains size is nearly uniform.

Two or more silver halide emulsions prepared separately may be used in combination.

Cadmium salts, zinc salts, lead salts, thalium salts, iridium salts or its complex salts, rhodium salts or its complex salts, iron salts or its complex salts, and so on may be allowed to coexist during the process of formation of silver halide grains or physical ripening.

In removing soluble salts from emulsions after the formation of precipitate or physical ripening, there may be employed a noodle rinsing method in which the removal of soluble salts is attained by gelling gelatin. In addition, a flocculation method may be employed which utilizes inorganic salts, anionic surfactants, anionic polymers (e.g., polystyrenesulfonic acid), or gelatin derivatives (e.g., acylated gelatin and carbamoylated gelatin).

For chemical sensitization of silver halide emulsions, for example, procedures as described in H. Frieser ed., *Die Grundlagent der Photographischen Prozess mit Silberhalogenden,* Akademische Verlagsgesellschaft (1968), pages 675–734. That is, a sulfur sensitization method using sulfur-coating compounds capable of reacting with active gelatin and silver (e.g., thiosulfuric acid salts, thioureas, mercapto compounds, and rhodanines), a reduction sensitization method using reducing substances (e.g., stannous salts, amines, hydrazine derivatives, formamidinesulfinic acid, and silane compounds), a noble metal sensitization method using noble metal compounds (e.g., gold complex salts and complex salts of Group VIII metals (e.g., platinum, iridium, and palladium) of the Periodic Table), and so forth can be used singly or in combination with each other.

Into photographic emulsions as used herein can be incorporated various compounds for the purpose of preventing the formation of fog during the process of preparation, storage or photographic processing of light-sensitive materials, or for the purpose of stabilizing the photographic performance. That is, a number of compounds known as antifoggants or stabilizers can be added, including azoles such as benzothiazolium salts, nitroindazoles, triazoles, benzotriazoles, and benzimidazoles (especially nitro- or halogen-substituted ones); heterocyclic mercapto compounds such as mercaptothiazoles, mercaptobenzothiazoles, mercaptobenzimidazoles, mercaptothiadiazoles, mercaptotetrazoles (especially 1-phenyl-5-mercaptotetrazole), and mercaptopyrimidines; the foregoing heterocyclic mercapto compounds further having water-soluble groups such as a carboxyl group and a sulfo group; thioketo compounds such as oxazolinethione; azaindenes such as tetrazaindenes (especially 4-hydroxy-substituted (1,3,3a,7)tetrazaindenes); benzenesulfonic acids; and benzenesulfinic acid.

Photographic emulsion layers and other hydrophilic colloid layers to be used in the preparation of the light-sensitive material of the present invention may contain various surfactants as coating aids or for the purpose of preventing static charge, improving sliding properties, preventing adhesion, or improving photographic properties (such as acceleration of development, hardening, and sensitization). Examples are natural surfactants such as saponin (sterioid-based), nonionic surfactants such as alkyleneoxide derivatives (e.g., polyethylene glycol, polyethylene glycol/polypropylene glycol condensates, polyethylene glycol alkyl ethers or polyethylene glycol alkylaryl ethers, polyethylene glycol esters, polyethylene glycol sorbitan esters, polyalkylene glycol alkylamine or amides, and polyethylene oxide adducts of silicone), glycidol derivatives (e.g., alkenylsuccinic acid polyglyceride and alkylphenol polyglyceride), fatty acid esters of polyhydric alcohols, and alkyl esters of sucrose; anionic surfactants containing acidic groups such as a carboxyl group, a sulfo group, a phospho group, a sulfate group, and a phosphate group, such as alkylcarboxylic acid salts, alkylsulfonic acid salts, alkylbenzenesulfonic acid salts, alkylnaphthylenesulfonic acid salts, alkylsulfuric acid esters, alkylphosphoric acid esters, N-acyl-N-alkyldaurins, sulfosuccinic acid esters, sulfoalkylpolyoxyethylene alkylphenyl ethers, and polyoxyethylene alkylphosphoric acid esters; amphoteric surfactants such as aminoacids, aminoalkylsulfonic acids, aminoalkylsulfuric acid or phosphoric acid esters, alkylbetaines, and amineoxides; and cationic surfactants such as alkylamine salts, aliphatic or aromatic quaternary ammonium salts, heterocyclic quaternary ammonium salts (e.g., pyridinium and imidazolium), and aliphatic or heterocyclic phosphonium or sulfonium salts.

The photographic emulsion layers of the light-sensitive material of the present invention may contain compounds such as polyalkylene oxide or its ether, ester or amine derivatives, thioether compounds, thiomorpholines, quaternary ammonium salts, urethane derivatives, urea derivatives, imidazole derivatives, and 3-pyrazolidones for the purpose of increasing sensitivity, increasing contrast, or of accelerating development.

The light-sensitive material of the present invention may contain dispersions of water-insoluble or sparingly soluble polymers in the photographic emulsion layer and other hydrophilic colloid layers for the purpose, e.g., of improving dimensional stability. These polymers include homo or copolymers of monomers such as alkyl acrylate or methacrylate, alkoxy acrylate or methacrylate, glycidyl acrylate or methacrylate, acrylamide or methacrylamide, vinyl esters (e.g., vinyl acetate), acrylonitrile, olefins, and styrene, and copolymers of the foregoing monomers and acrylic acid, methacrylic acid, $\alpha,\beta$-unsaturated dicarboxylic acid, hydroxyalkyl acrylate or methacrylate, sulfoalkyl acrylate or methacrylate, styrenesulfonic acid, and so on.

For photographic processing of the light-sensitive material of the present invention, any known procedures and processing solutions as described in, for example, *Research Disclosure,* No. 176, pages 28–30 (RD-17643) can be applied. This photographic processing may be a black-and-white processing or a photographic processing to form dye images (color photographic processing) depending on the purpose. The processing temperature is usually chosen within the range of from 18° to 50° C. Higher temperatures than 18° C. or lower temperatures than 50° C. can also be used.

As a special mode of development, there may be used a method in which a developing agent is incorporated into a light-sensitive material, e.g., an emulsion layer, and the light-sensitive material is developed by treating in an alkaline aqeous solution. Among developing agents, hydrophobic ones can be introduced into emulsion layers by various procedures such as the methods described in Research Disclosure, No. 169 (RD-16928), U.S. Pat. No. 2,739,890, British Patent No. 813,253, and West German Patent No. 1,547,763. The developing processing may be performed in combination with a silver salt-stabilizing processing using thiocyanic acid salts.

Fixers of commonly used compositions can be used in the present invention. As these fixers, as well as thiosulfuric acid salts and thiocyanic acid salts, organosulfur compounds which are known to be effective as fixers can be used. The fixers may contain water-soluble aluminum salts as hardening agents.

Dye images can be formed in the light-sensitive material of the present invention in the usual manner. For example, a negative/positive method, as described, for example, in *Journal of the Society of Motion Picture and Television Engineers,* Vol. 61, (1953), pages 667–701 can be employed.

Color developers are generally alkaline aqueous solution containing color developing agents. As color developing agents, known primary aromatic amine developing agents can be used, including phenylene diamines such as 4-amino-N,N-diethylaniline, 3-methyl-4-amino-N,N-diethylaniline, 4-amino-N-ethyl-N-$\beta$-hydroxyethylaniline, 3-methyl-4-amino-N-ethyl-N-$\beta$-hydroxyethylaniline, 3-methyl-4-amino-N-ethyl-N-$\beta$-methanesulfoamidoethylaniline, and 4-amino-3-methyl-N-ethyl-N-$\beta$-methoxyethylaniline.

In addition, color developing agents as described in L. F. A. Mason, *Photographic Processing Chemistry,* The Focal Pres Co., (1966), pages 226–229, U.S. Pat. Nos. 2,193,015, 2,592,364, and Japanese Patent Application (OPI) No. 64933/73 can be used.

The color developer can additionally contain additives such as pH buffers, development inhibitors and antifoggants. If necessary, hard water-softening agents, preservatives, organic solvents, development accelerators, dye-forming couplers, competitive couplers, fogging agents, auxiliary developing agents, tackifiers, polycarboxylic acid-based chelating agents, antioxidants, and so forth may be added.

Representative examples of such additives are described in *Research Disclosure* (RD-17643), U.S. Pat.

No. 4,083,723, and West German Patent Application (OLS) No. 2,622,950.

After color development, the photographic emulsion layer is usually bleached. This bleaching may be performed simultaneously with fixing, or they may be performed separately. Bleaching agents which can be used include polyvalent metal (e.g., iron (III), cobalt (III), chromium (VI), and copper (II) compounds, peracids, quinones, and nitroso compounds. Examples are ferricyanides; dichromic acid salts, organic complex salts of iron (III) and cobalt (III), such as complex salts of aminopolycarboxylic acids (e.g., ethylenediaminetetraacetic acid, nitrilotriacetic acid and 1,3-diamino-2-propanoltetraacetic acid) or organic acids (e.g., citric acid, tartaric acid and malic acid); persulfuric acid salts, permanganic acid salts; and nitrosophenol. Of these compounds, potassium ferricyanide, iron (III) sodium ethylenediaminetetraacetate, and iron (III) ammonium ethylenediaminetetraacetate are particularly useful. Ethylenediaminetetraacetic acid iron (III) complex salts are useful in both an independent bleaching solution and a combined bleach-fixing solution.

To these bleaching or bleach-fixing solutions can be added various additives such as bleach accelerators as described in U.S. Pat. Nos. 3,042,520, 3,241,966, Japanese Patent Publication Nos. 8506/70 and 8836/70, and thiol compounds as described in Japanese Patent Application (OPI) NO. 65732/78.

The light-sensitive material of the present invention is prepared by coating photographic emulsion layers and other layers on a flexible support such as a plastic film, paper, or cloth, or a rigid support made of, e.g., glass, porcelain or metal. Useful examples of such flexible supports are films of semi-synthetic or synthetic polymers such as cellulose nitrate, cellulose acetate, cellulose acetate butyrate, polystyrene, polyvinyl chloride, polyethylene terephthalate, and polycarbonate, and paper coated or laminated with a baryta layer or α-olefin polymers (e.g., polyethylene, polypropylene and an ethylene/butene copolymer). The support may be colored with dyes or pigments. It may be colored black for the purpose of shielding light. The surface of the support is usually subjected to a subbing treatment in order to enhance the adhesion with photographic emulsion layers and so forth. Before or after the subbing treatment, corona discharge, irradiation with ultraviolet rays, flame treatment, and so forth may be applied on to the surface of the support.

The light-sensitive material of the present invention may contain inorganic or organic hardening agents in the photographic emulsion layers and other hydrophilic colloid layers thereof. For example, chromium salts (e.g., chromium alum and chromium acetate), aldehydes (e.g., formaldehyde, glyoxal, and glutaraldehyde), N-methylol compounds (e.g., dimethylol urea and methyloldimethyl hydantoine), dioxane derivatives (e.g., 2,3-dihydroxydioxane), active vinyl compounds (i.e., 1,3,5-triacryloyl-hexahydro-s-triazine and 1,3-vinylsulfonyl-2-propanol), active halogen compounds (e.g., 2,4-dichloro-6-hydroxy-s-triazine), mucohalogenic acids (mucochloric acid and mucophenoxychloric acid), and so forth can be used singly or in combination with each other.

When dyes, ultraviolet absorbers, etc., are contained in the hydrophilic colloid layer of the light-sensitive material of the present invention, they may be mordanted with cationic polymers, for example.

The light-sensitive material of the present invention may contain, as anticolorfoggants, hydroquinone derivatives, aminophenol derivatives, gallic acid derivatives, ascorbic acid derivatives, and so forth.

The light-sensitive material of the present invention may contain ultraviolet absorbers in the hydrophilic colloid layer thereof. Ultraviolet absorbers which can be used include aryl group-substituted benzotriazole compounds, 4-thiazolidone compounds, benzophenone compounds, cinnamic acid ester compounds, butadiene compounds, and benzooxazole compounds. In addition, ultraviolet absorbing polymers, and the like can be used. These ultraviolet absorbers may be fixed in the above-described hydrophilic colloid layer.

In the light-sensitive material of the present invention, the hydrophilic colloid layer may contain water-soluble dyes as filter dyes or for other various purposes, such as for preventing irradiation. These dyes include an oxonol dye, a hemioxonol dye, a styryl dye, a merocyanine dye, a cyanine dye, and an azo dye. Of these compounds, an oxonol dye, a hemioxonol dye, and a merocyanine dye are useful.

In the practice of the present invention, known anti-fading agents can be used. Color image stabilizers as used in the present invention can be used singly or in combination with each other. The known anti-fading agents include hydroquinone derivatives, gallic acid derivatives, p-alkyoxyphenols, p-oxyphenol derivatives, and bisphenols.

The present invention is described in greater detail with reference to the following example, but the present invention should not be construed as being limited thereto.

EXAMPLE

A multilayer color light-sensitive material was prepared by coating a cellulose triacetate film support with the following layers:

First Layer (Antihalation Layer)

A gelatin layer containing black colloid silver.

Second Layer (Intermediate Layer)

A gelatin layer containing a dispersion of 2,5-di-n-pentadecylhydroquinone.

Third Layer (Red-Sensitive Low-Sensitivity Silver Halide Emulsion Layer)

Silver iodobromide emulsion (silver iodide: 5 mol%; mean grain size: 0.7μ): 1.3g/m$^2$ (calculated as silver)

Sensitizing dye I: $6\times10^{-5}$ mol per mol of silver

Sensitizing dye II: $1.5\times10^{-5}$ mol per mol of silver

Coupler C-4: 0.04 mol per mol of silver

Coupler D: 0.003 mol per mol of silver

Fourth Layer (Red-Sensitive Intermediate-Sensitivity Silver Halide Emulsion Layer)

Silver iodobromide emulsion (silver iodide: 5.5 mol%; mean grain size 0.9μ): 1.3 g/m$^2$ Sensitizing dye I: $5\times10^{-5}$ mol per mol of silver Sensitizing dye II: $1.2\times10^{-5}$ mol per mol of silver Coupler 2: 0.04 mol per mol of silver Coupler C-2: 0.004 mol per mol of silver Coupler D: 0.001 mol per mol of silver Fifth Layer (Red-Sensitive High-Sensitivity Silver Halide Emulsion Layer)

Silver iodobromide emulsion (silver iodide: 8 mol%; mean grain size: 1.2μ): 1.5 g/m$^2$ (calculated as silver)

Sensitizing dye I: $5\times10^{-5}$ mol per mol of silver

Sensitizing dye II: $1.2\times10^{-5}$ mol per mol of silver

Coupler C-1: 0.012 mol per mol of silver
Coupler C-3: 0.002 mol per mol of silver Sixth Layer (Inter Layer)
Same as the second layer.

Seventh Layer (Green-Sensitive Low-Sensitivity Silver Halide Emulsion Layer)
Silver iodobromide emulsion (silver iodide: 5 mol% mean grain size: 0.7μ): 0.7 g/m² (calculated as silver)
Sensitizing dye III: $3\times10^{-5}$ mol per mol of silver
Sensitizing dye IV: $1\times10^{-5}$ mol per mol of silver
Coupler M-1: 0.12 mol (with one active site as one mole) per mol of silver
Coupler M-2: 0.012 mol per mol of silver
Coupler M-3: 0.006 mol per mol of silver
Coupler D: 0.012 mol per mol of silver Eighth Layer (Green-Sensitive Intermediate-Sensitivity Silver Halide Emulsion Layer)
Silver iodobromide (silver iodide: 5 mol%; mean grain size: 0.9μ): 2.5 g/m² (calculated as silver)
Sensitizing dye III: $2.5\times10^{-5}$ mol per mol of silver
Sensitizing dye IV: $0.8\times10^{-5}$ mol per mol of silver
Coupler M-4: 0.05 mol per mol of silver
Coupler M-2: 0.005 mol per mol of silver
Coupler D: 0.001 mol per mol of silver
Coupler M-3: 0.005 mol per mol of silver
Coupler M-5: 0.02 mol per mol of silver Ninth Layer (Green-Sensitive High-Sensitivity Silver Halide Emulsion Layer)
Silver iodobromide emulsion (silver iodide: 8 mol%; mean grain size: 1.1μ): 3.0 g/m²
Sensitizing dye III: $2.1\times10^{-5}$ mol per mol of silver
Sensitizing dye IV: $0.7\times10^{-5}$ mol per mol of silver
Coupler M-5: 0.0125 mol per mol of silver
Coupler M-2: 0.002 mol per mol of silver Tenth Layer (Yellow Filter Layer)
A gelatin layer containing a dispersion of gelatin, yellow colloid silver and 2,5-di-n-pentadecylhydroquinone.

Eleventh Layer (Blue-Sensitive Low-Sensitivity Silver Halide Emulsion Layer)
Silver iodobromide emulsion (silver iodide: 5 mol%; mean grain size: 0.7μ): 0.3 g/m² (calculated as silver)
Coupler Y: 0.2 mol per mol of silver
Coupler D: 0.02 mol per mol of silver Twelfth Layer (Blue-Sensitive Intermediate-Sensitivity Silver Halide Emulsion Layer)
Silver iodobromide emulsion (silver iodide: 6 mol%; grain size 0.9μ): 0.4 g/m² (calculated as silver)
Coupler Y: 0.1 mol per mol of silver Thirteenth Layer (Blue-Sensitive High-Sensitivity Silver Halide Emulsion Layer)
Silver iodobromide emulsion (Silver iodide: 8.5 mol%; mean grain size: 1.4μ): 0.8 g/m² (calculated as silver)
Coupler Y: 0.05 mol per mol of silver Fourteenth Layer (First Protective Layer)
A gelatin layer containing a dispersion of equal amounts of ultraviolet absorbers UV-1 and UV-2.

Fifteenth Layer (Second Protective Layer)
A gelatin layer containing trimethyl methacrylate particles (diameter: about 1.5μ)

In the formation of each layer, a given amount of coupler was added to a mixed solvent of tricresyl phosphate and ethyl acetate, dissolved therein by heating in the presence of sodium p-dodecylbenzenesulfonate as an emulsifier, and mixed with a 10% gelatin solution which had been heated and, thereafter, the resulting mixture was emulsified with a colloid mill and then applied.

To each layer, as well as the above-described ingredients, a gelatin hardening agent, a surfactant, and so forth were added.

The thus-prepared light-sensitive material is designated as "Sample 101".

The compounds used in the preparation of Sample 101 were as follows:

Sensitizing dye I: anhydro-5,5'-dichloro-3,3'-di-(γ-sulfopropyl)-9-ethylthiacarbocyaninhydroxide pyridinium salt Sensitizing dye II: anhydro-9-ethyl-3,3'-di-(γ-sulfopropyl)-4,5,4',5'-dibenzothiacarbocyaninhydroxide triethylamine salt Sensitizing dye III: anhydro-9-ethyl-5,5'-dichloro-3,3'-di-(γ-sulfopropyl)oxacarbocyanine sodium salt Sensitizing dye IV: anhydro-5,6,5',6'-tetrachloro-1,1'-diethyl-3,3'-di-{β-[β-(γ-sulfopropoxy)ethoxy]ethyl-}imidazolocarbocyaninehydroxide sodium salt

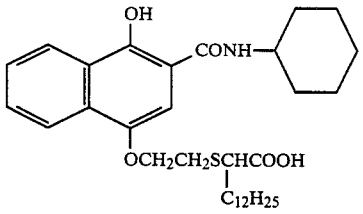

Coupler C-1

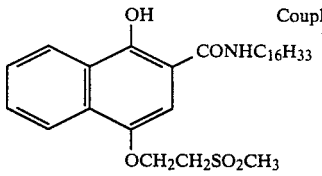

Coupler C-2

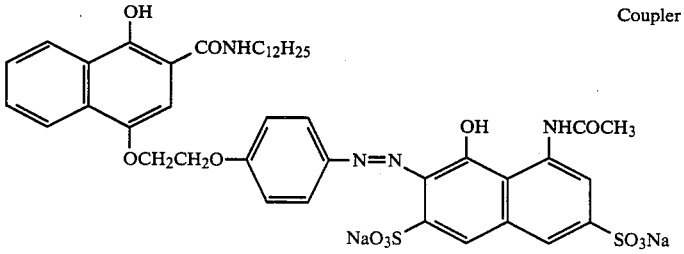

Coupler C-3

-continued
Coupler C-4
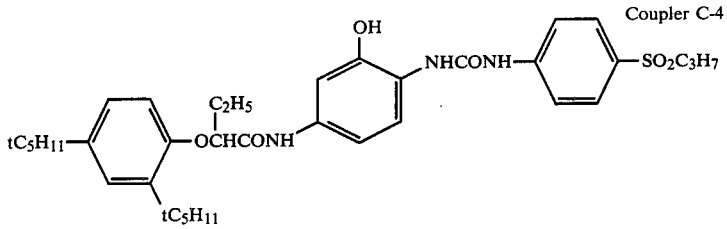
Coupler M-1
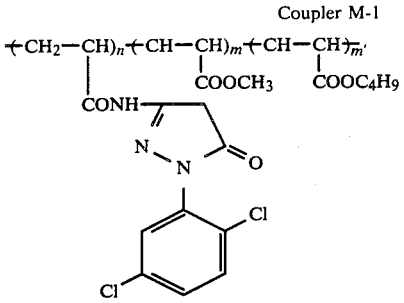
n/m + m' = 1 m/m' = 1 (weight ratio)
molecular weight: about 40,000
Coupler M-2
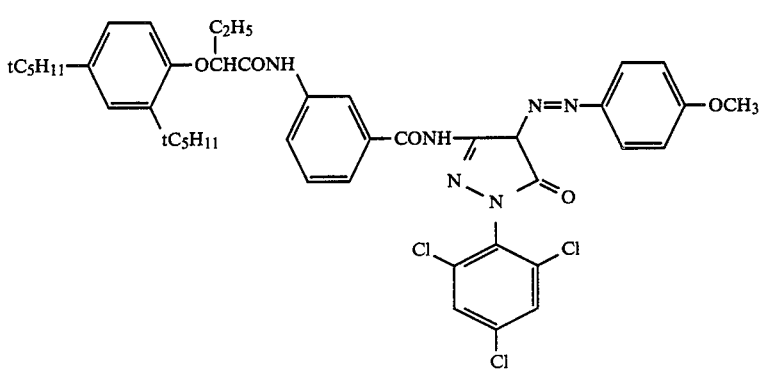
Coupler M-3
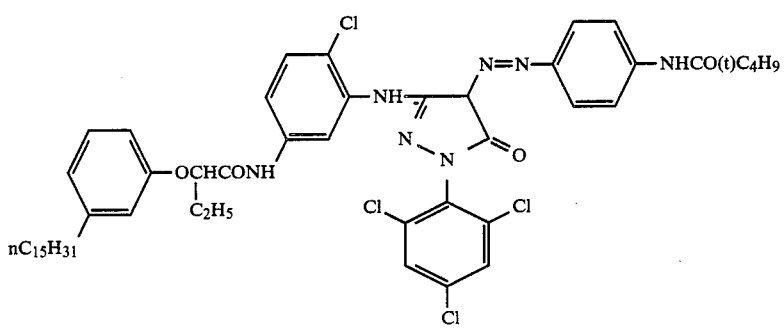
Coupler M-4
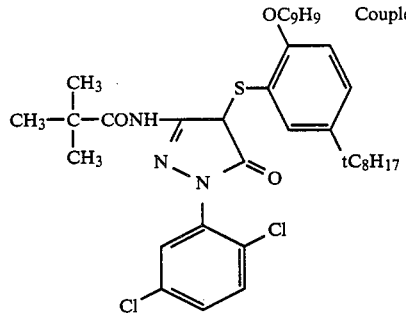
Coupler M-5
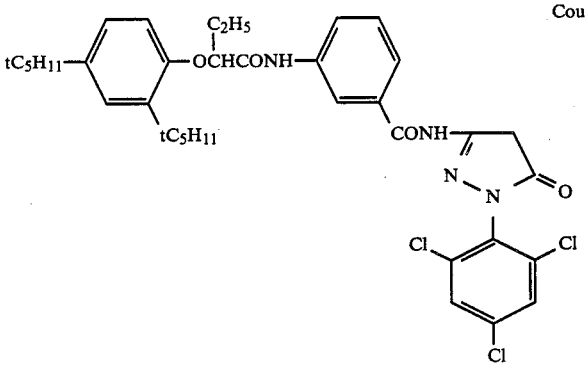

-continued

Coupler Y

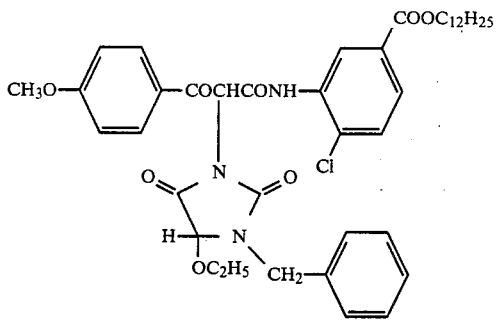

UV-1

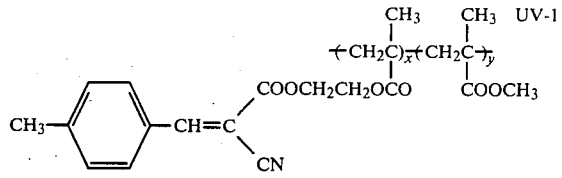

x/y = 7/3 (weight ratio)

UV-2

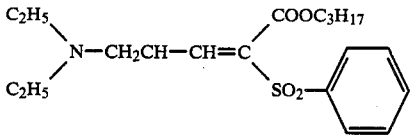

Coupler D

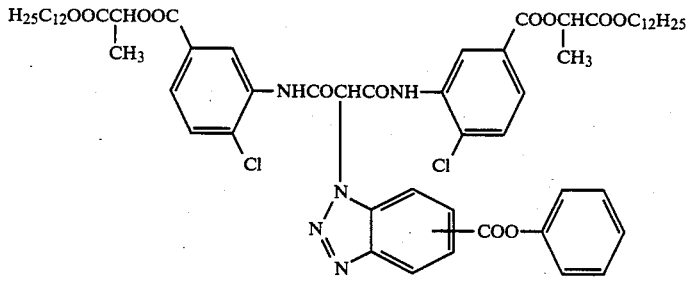

Preparation of Sample 102

An ultra-high sensitivity sample was prepared by providing the light-sensitive layer unit of the present invention.

This light-sensitive material had the following layer structure:

First Layer to Thirteenth Layer

Same as in Sample 101.

Fourteenth Layer (Inter Layer)

Same as the second layer.

Fifteenth Layer (Ultra-High Sensitivity Blue/Red-Sensitive Layer)

Silver iodobromide emulsion (silver iodide: 8 mol%; mean grain size: 1.4μ): 1.0 g/m$^2$ (calculated as silver)

Sensitizing dye I: $3\times10^{-5}$ mol per mol of silver

Sensitizing dye II: $0.72\times10^{-5}$ mol per mol of silver

Coupler C-1: 0.008 mol per mol of silver

Coupler 28: 0.004 mol per mol of silver

Sixteenth Layer (Inter Layer)

Same as the second layer.

Seventeenth Layer (Ultra-High Sensitivity Blue/-Green-Sensitive Layer)

Silver iodobromide emulsion (silver iodide: 8 mol%; mean grain size: 1.4μ): 1.0 g/m$^2$ (calculated as silver)

Sensitizing dye III: $1.2\times10^{-5}$ mol per mol of silver

Sensitizing dye IV: $0.42\times10^{-5}$ mol per mol of silver

Coupler M-5: 0.006 mol per mol of silver

Coupler 1: 0.003 mol per mol of silver

Eighteenth Layer (First Protective Layer)

Same as the fourteenth layer of Sample 101.

Nineteenth Layer (Second Protective Layer)

Same as the fifteenth layer of Sample 101.

Preparation of Sample 103

For comparison with Sample 102, Sample 103 was prepared.

This light-sensitive material had the following layer structure:

First Layer (Antihalation Layer)

Same as the first layer of Sample 101.

Second Layer (Inter Layer)

Same as the second layer of Sample 101.

Third Layer (Red-Sensitive Low-Sensitivity Silver Halide Emulsion Layer)

Same as the third layer of Sample 101.

Fourth Layer (Red-Sensitive Intermediate-Sensitivity Silver Halide Emulsion Layer)

Same as the fourth layer of Sample 101.

Fifth Layer (Red-Sensitive High-Sensitivity Silver halide Emulsion Layer)

Same as the fifth layer of Sample 101.

Sixth Layer (Red-Sensitive Ultra-High Sensitivity Silver Halide Emulsion Layer)

Silver iodobromide emulsion (silver iodide: 8 mol%; mean grain size: 1.4μ): 1.0 g/m$^2$ (calculated as silver)

Sensitizing dye I: $4\times10^{-5}$ mol per mol of silver

Sensitizing dye II: 0.96 mol per mol of silver

Coupler C-1: 0.008 mol per mol of silver

Seventh Layer

Same as the second layer of Sample 101.

Eighth Layer (Green-Sensitive Low-Sensitivity Silver Halide Emulsion Layer)

Same as the seventh layer of Sample 101.

Ninth Layer (Green-Sensitive Intermediate-Sensitivity Silver Halide Emulsion Layer)

Same as the eighth layer of Sample 101.

Tenth Layer (Green-Sensitive High-Sensitivity Silver Halide Emulsion Layer)

Same as the ninth layer of Sample 101.

Eleventh Layer (Green-Sensitive Ultra-High-Sensitivity Silver Halide Emulsion Layer)

Silver iodobromide emulsion (silver iodide: 8 mol%; mean grain size: 1.4μ): 1.0 g/m$^2$ (calculated as silver)

Sensitizing dye III: $1.7\times10^{-5}$ mol per mol of silver

Sensitizing dye IV: $0.56\times10^{-5}$ mol per mol of silver

Coupler M-5: 0.006 mol per mol of silver

Twelfth Layer to Seventeenth Layer

Same as the tenth layer to the fifteenth layer of Sample 101.

Samples 101 to 103 were each exposed to white light through a wedge and then processed at 38° C. as follows:

| Step | Time (min) |
|---|---|
| 1. Color development | 3.25 |
| 2. Bleaching | 6.5 |
| 3. Rinsing | 3.25 |
| 4. Fixing | 6.5 |
| 5. Rinsing | 3.25 |
| 6. Stabilization | 3.25 |

The composition of the processing solution used at each step was as follows:

Color Developer

Sodium nitrotriacetate: 1.0 g
Sodium sulfite: 4.0 g
Sodium carbonate: 30.0 g
Potassium bromide: 1.4 g
Hydroxyamine sulfuric acid salt: 2.4 g
4-(N-ethyl-N-β-hydroxyethylamino)-2-methylaniline sulfuric acid salt: 4.5 g
Water to make: 1 liter Bleaching Solution Ammonium bromide: 160.0 g
Ammonia water (28%): 25.0 ml
Sodium iron ethylenediaminetetraacetate: 130 g
Glacial acetic acid: 14 ml
Water to make: 1 liter Fixer Sodium tetrapolyphosphate: 2.0 g
Sodium sulfite: 4.0 g
Ammonium thiosulfate (70%): 175.0 ml
Sodium hydrogensulfite: 4.6 g
Water to make: 1 liter Stabilizer Formalin: 8.0 ml
Water to make: 1 liter Samples 101 to 103 were measured for the sensitivity for each of blue light, green light and red light. The results are shown in the Table below.

Table

| Run No. | Sample | Relative Sensitivity | | |
|---|---|---|---|---|
| | | B | G | R |
| 1 (control) | 101 | 100 | 100 | 100 |
| 2 (example of the invention) | 102 | 270 | 305 | 350 |
| 3 (comparative example) | 103 | 102 | 113 | 108 |

The results shown in the Table confirmed that Sample 102 (a light-sensitive material of the present invention) was of higher sensitivity than Sample 103 having the same silver halide grain size and amount of silver coated.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising a support and a light-sensitive layer unit (I), (II) or (III) in the high sensitivity color emulsion layer area wherein the light-sensitive layer unit is capable of producing a color density of from 0.05 to 0.4 upon development, the remaining color density being produced by a second light-sensitive layer unit comprising a blue-sensitive layer, a green-sensitive layer and a red-sensitive layer which is provided between the light-sensitive layer unit (I), (II) or (III) and the support:

Unit (I)

a light-sensitive layer unit comprising:

(a) a silver halide light-sensitive layer which contains a color-forming combination of (a-1) a yellow image-forming coupler, (a-2) a magenta image-forming coupler, and (a-3) a cyan colored coupler, and which is blue-sensitive and green sensitive; and (b) a silver halide light-sensitive layer which contains a color-forming combination of (b-1) a cyan image-forming coupler, (b-2) a magenta image-forming coupler, and (b-3) a yellow colored coupler, and which is green-sensitive and red-sensitive;

Unit (II)

a light-sensitive layer unit comprising:

(a) a silver halide light-sensitive layer which contains a color-forming combination of (a-1) a yellow image-forming coupler, (a-2) a cyan image-forming coupler, a (a-3) a magenta colored coupler, and which is blue-sensitive and red-sensitive; and (b) a silver halide light-sensitive layer which contains a color-forming combination of (b-1) a magenta image-forming coupler, (b-2) a cyan image-forming coupler, a (b-3) a yellow colored coupler, and which is green-sensitive and red-sensitive;

Unit (III)

a light-sensitive layer unit comprising:

(a) a silver halide light-sensitive layer which contains a color-forming combination of (a-1) a magenta image-forming coupler, (a-2) a yellow image-forming coupler, a (a-3) a cyan colored coupler, and which is blue-sensitive and green-sensitive; and (b) a silver halide light-sensitive layer which contains a color-forming combination of (b-1) a cyan image-forming coupler, (b-2) a yellow image-forming coupler, and (b-3) a magenta colored coupler, and which is blue-sensitive and red-sensitive.

2. A silver halide color photographic light-sensitive material as in claim 1, comprising a negative-working color photographic light-sensitive material.

3. A silver halide color photographic light-sensitive material as in claim 1, wherein any of layer units (I), (II) and (III), the light-sensitive layer (a) is spaced apart from the support by the light-sensitive layer (b).

4. A silver halide color photographic light-sensitive material as in claim 2, wherein in any of layer units (I), (II) and (III), the light-sensitive layer (a) is spaced apart from the support by the light-sensitive layer (b).

5. A silver halide color photographic light-sensitive material as claimed in claim 1, wherein the magenta image-forming coupler is selected from the group consisting of a 5-pyrazolone coupler, a pyrazolobenzimidazole coupler, a cyanoacetylcumarone coupler, an open-chain acylacetonitrile coupler and a pyrazolotriazole coupler; the yellow image-forming coupler is an acylacetamide coupler; the cyan image-forming coupler is a naphthol coupler or a phenol coupler; and the colored couplers are represented by formulae (I) or (II):

A-L-Dye—(I)

A-N=N-B—(II)

wherein

A is a residue resulting from removal of one hydrogen atom existing at the coupling active site of the coupler;

L is a group connected to the active site of the coupler having Dye as a substituent which is capable of being released after the coupler couples with an oxidized developing agent;

Dye is a dye or group which is capable of being converted into a dye by development;

and B is an aliphatic hydrocarbon group, an aromatic group or a heterocyclic group.

6. A silver halide color photographic light-sensitive material as claimed in claim 1, wherein the ratio of the color density of (a-1) to the color density of (a-2) to the mask density of (a-3) in the light-sensitive layer unit is about 2:1:1.

* * * * *